United States Patent [19]

Martucci

[11] 4,025,139

[45] May 24, 1977

[54] REDUNDANT ELECTRICAL GROUNDING SYSTEM

[75] Inventor: Frank C. Martucci, Fort Lee, N.J.

[73] Assignee: The Raymond Lee Organization, Inc., New York, N.Y. ; a part interest

[22] Filed: Aug. 30, 1976

[21] Appl. No.: 718,865

[52] U.S. Cl. ..... 339/14 R

[51] Int. Cl.[2] ..... H01R 3/06

[58] Field of Search ..... 339/14 R, 14 P, 14 L, 339/62, 154 A, 156 R, 157 R, 166 R, 176 R, 176 M, 184 R, 191 R, 191 M, 192 R, 195 R, 195 M, 278 M

[56] References Cited

UNITED STATES PATENTS

| | | | |
|---|---|---|---|
| 3,072,873 | 1/1963 | Traher | 339/14 R |
| 3,626,354 | 12/1971 | Banner | 339/14 R |

*Primary Examiner*—Roy Lake
*Assistant Examiner*—DeWalden W. Jones
*Attorney, Agent, or Firm*—Daniel Jay Tick

[57] ABSTRACT

A back-up grounding system for electrical appliances is used in hazardous locations. The redundant grounding line cord has two green grounding conductors instead of the usual one. A plurality of redundant grounding plugs and receptacles are provided to provide electrical appliances with two complete and separate grounding circuits.

7 Claims, 11 Drawing Figures

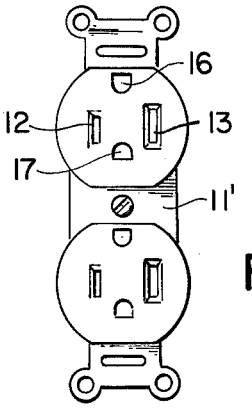
FIG. 9
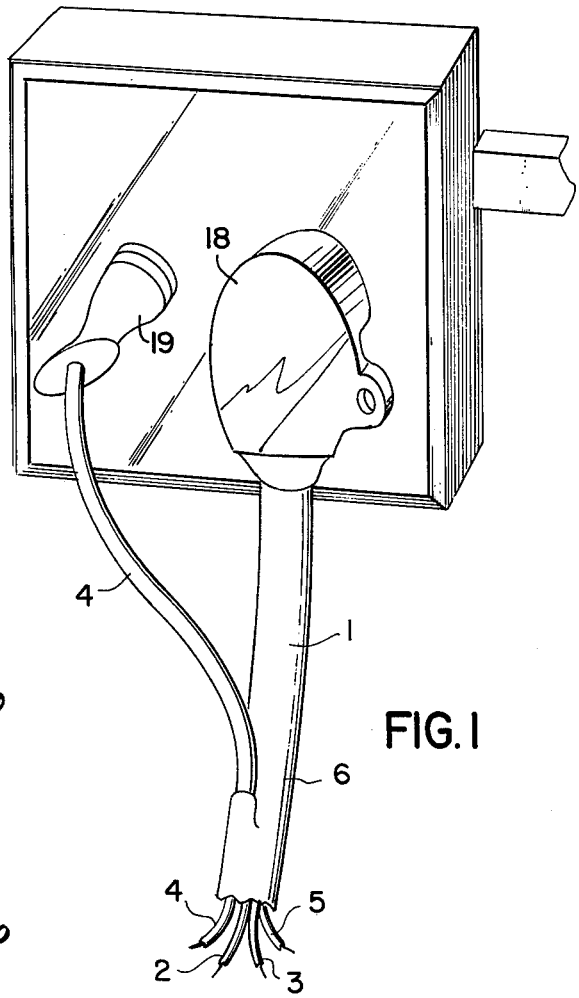
FIG. 1
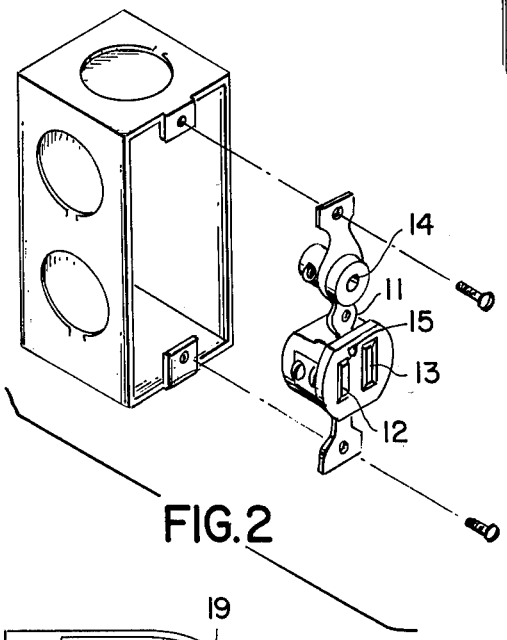
FIG. 2
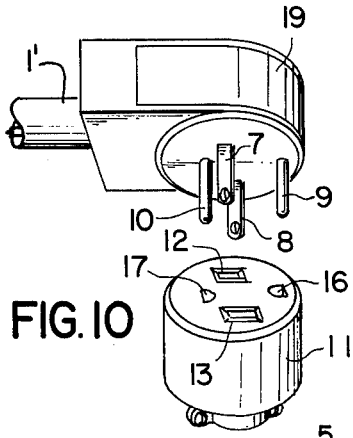
FIG. 8
FIG. 10
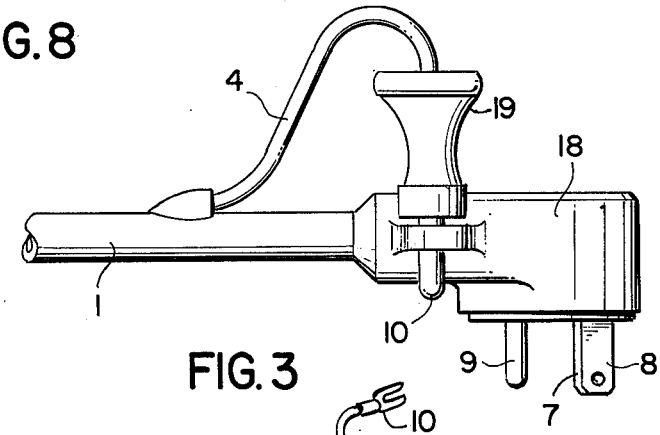
FIG. 3
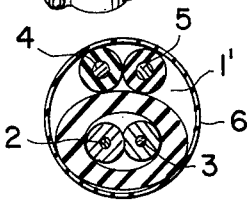
FIG. 7
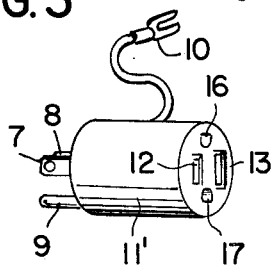
FIG. 11

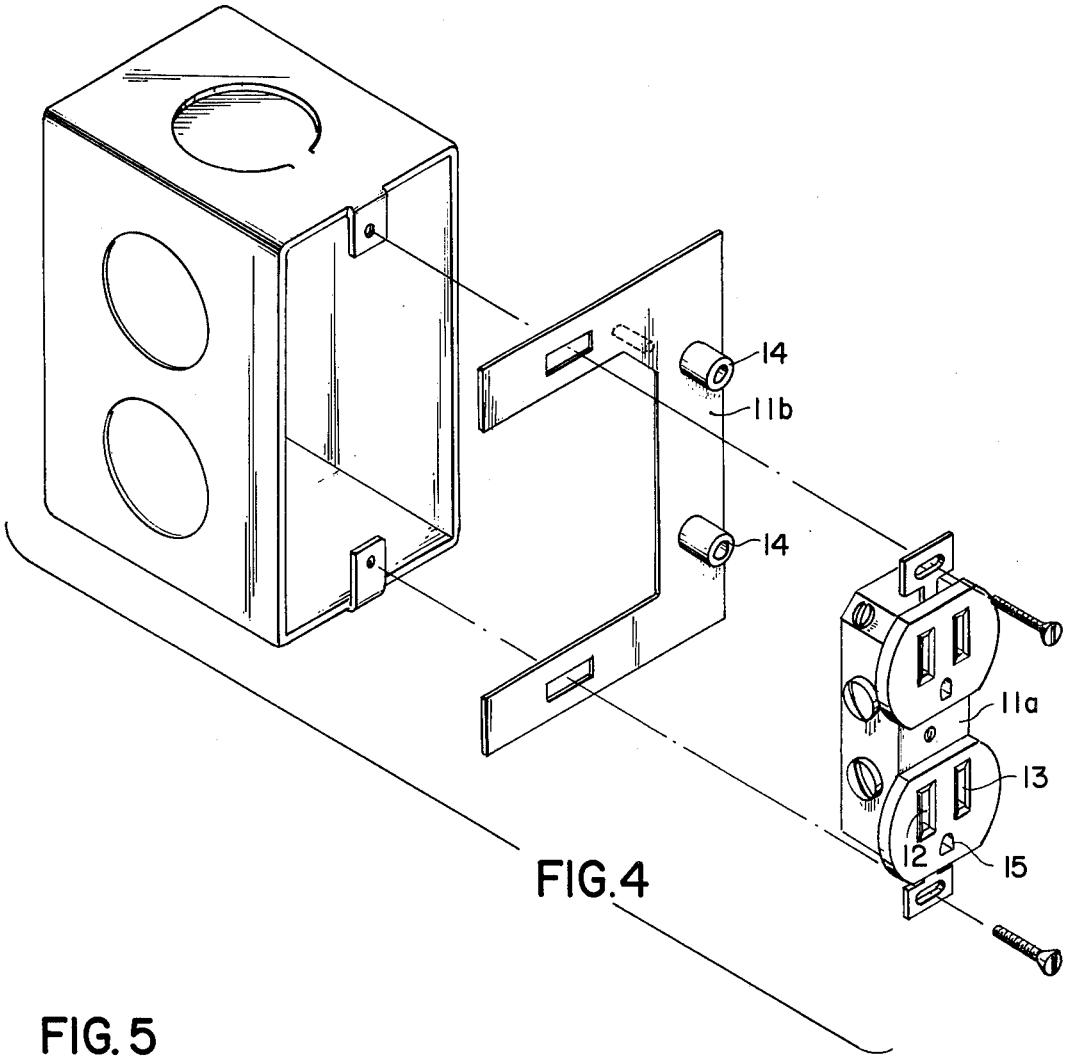
FIG. 4
FIG. 5
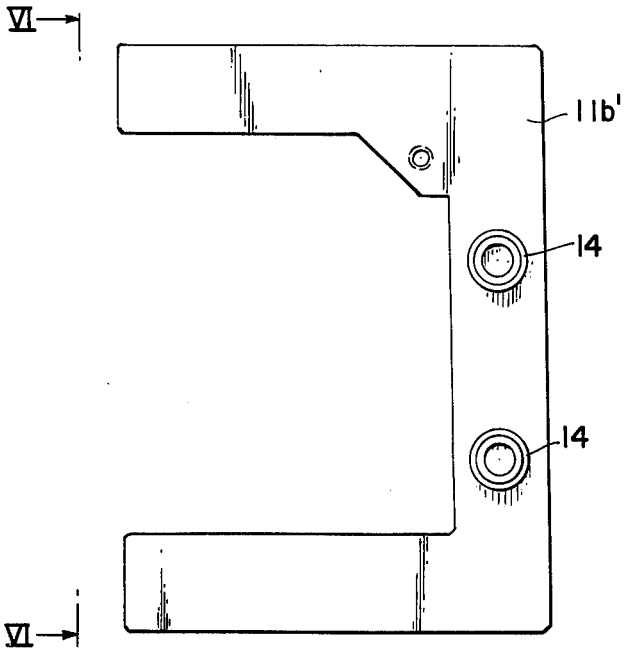
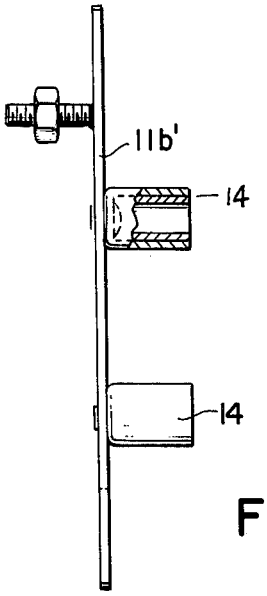
FIG. 6

REDUNDANT ELECTRICAL GROUNDING SYSTEM

BACKGROUND OF THE INVENTION

The present invention relates to a redundant electrical grounding system.

Every hospital bed has the same hazard of electrocution as a bathtub or swimming pool during the portion of its occupancy when it is wet with perspiration, leakage, or incontinence. The grounded metal stirrups of motorized tables and the wet operating, delivery, and hemo-dialysis rooms are equally hazardous areas. The hazard is increased by the invasion of the patient's body by instrumentation, illness, or intoxication. The patient, usually exposed to only one electrical appliance at a time in the safe, dry, ungrounded environment of the home, is subjected to an assemblage of appliances such as the electric bed, the examining lamp, the suction pump, the refrigerated blanket and the electrocardiograph.

Loss of any grounding circuit due to a defective plug, receptacle, cable, connection, or an improperly wired line cord subjects the patient to dangerous electric shock.

Because interruption of electric power is intolerable, current limiting devices which interrupt current on detection of ground fault current are not acceptable. Isolation transformers are extremely costly and require special low leakage receptacle wiring, appliances and power cables.

The recommended practice is the use of redundant grounding This is accomplished by attaching conductors from each appliance chassis to a grounded terminal plate at each receptacle. This is time consuming and requires the services of maintenance men who may not be available when appliances are installed or removed.

The system of the invention automatically provides redundant grounding, without loss of time or need for maintenance men, when the appliance operator connects the redundant grounding line cord plug into the redundant grounding wall receptacle.

All receptacles of the system of the invention are compatible with conventional three prong and two prong polarized plugs to prevent interruption of service in area converted to redundant grounding receptacles. In like manner, appliances, manufactured with or converted to the single pulg redundant grounding system, may be utilized on conventionally grounded receptacles with the use of an inexpensive adapter.

BRIEF DESCRIPTION OF THE DRAWINGS

In order that the invention may be readily carried into effect, it will now be described with reference to the accompanying drawings, wherein:

FIG. 1 is a perspective view of an embodiment of the redundant electrical grounding system of the invention;

FIG. 2 is a view of an embodiment of a receptacle of the redundant electrical grounding system of the invention, in exploded relation with its box;

FIG. 3 is a view of the embodiment of the electrically conductive device of FIG. 1 in a specific condition;

FIG. 4 is an exploded perspective view of still another embodiment of the redundant electrical grounding system of the invention, illustrating the use of the adapter plate for conversion of existing outlets;

FIG. 5 is a view, on a enlarged scale, of another embodiment of the adapter plate for the embodiment of FIG. 4;

FIG. 6 is a view, partly cutaway, and partly in section, taken along the lines VI-VI, of FIG. 5;

FIG. 7 is a cross-sectional view of another embodiment of the electrically conductive device of the redundant electrical grounding system of the invention;

FIG. 8 is a perspective view of still another embodiment of the conductive device of the redundant electrical grounding system of the invention;

FIG. 9 is a view of still another embodiment of the receptacle of the redundant electrical grounding system of the invention;

FIG. 10 is a perspective view of a single unit of the embodiment of the receptacle of FIG. 9; and FIG. 11 is a perspective view of a converter for the electrically conductive device of the redundant electrical grounding system of the invention to a single ground conductor prong.

DETAILED DESCRIPTION OF THE INVENTION

The redundant electrical grounding system of the invention comprises electrically conductive devices 1 (FIGS. 1 and 3) and 1' (FIGS. 7 and 8) including two current conductors 2 and 3 and two ground conductors 4 and 5 each covered with electrical insulation, as shown in FIGS. 1 and 7, and all housed in an overall sheath 6 of electrical insulation (FIGS. 1 and 7). The electrical insulation may comprise any suitable known type of electrical insulation of low leakage specification such as, for example, a rubber compound, or the like.

The redundant electrical grounding system of the invention further comprises a plurality of electrically conductive prongs including two prongs 7 and 8 of substantially flat configuration, each electrically connected to a corresponding one of the current conductors 2 and 3, and two prongs 9 and 10 of substantially U-shaped cross-section, each electrically connected to a corresponding one of the ground conductors 4 and 5 (FIGS. 3 and 8).

The redundant electrical grounding system of the invention still further comprises a receptacle 11 (FIG. 2), 11*a*, 11*b* (FIG. 4), 11*b'* (FIGS. 5 and 6), or 11' (FIGS. 9, 10 and 11). Each of the receptacles 11; 11*a*; 11*b*; 11*a*; 11*b'*; and 11' has a pair of slots 12 and 13 (FIGS. 2, 4, 9, 10 and 11) for accommodating the flat prongs 7 and 8 of the current conductors and a pair of openings 14 and 15 (FIGS. 2 and 4) or 16 and 17 (FIGS. 9 to 11) for accommodating the U-shaped cross-section prongs 9 and 10 of the ground conductors. Fruthermore, each of the receptacles of the redundant electrical grounding system has electrical conductors extending to the slots and openings thereof, in the usual manner of electrical receptacles, for making electrical contact with the prongs.

In the embodiment of FIGS. 1 and 3, the electrically conductive device further comprises a plug member 18 of electrically insulative material of any suitable type such as, for example, rubber, Bakelite, or the like, affixed to the electrical conductors and supporting the flat prongs 7 and 8 and one of the U-shaped cross-section prongs 9 spaced for use in conventional receptacles. The prongs 7, 8 and 9 are electrically connected to the conductors 2, 3 and 5, respectively, in the plug member 18. The ground conductor 4 extends out of the overall sheath 6 at a distance from the plug member of approximately 2 or 3 inches. The U-shaped cross-section prong 10 is affixed to the ground conductors 4.

In the embodiment of FIG. 8, a plug member 19 is affixed to the electrical conductors and comprises any suitable type of electrically insulative material, as does the plug member 18. The plug member 19 supports the prongs 7, 8, 9 and 10 and said prongs are electrically connected to the corresponding electrical conductors in said plug member.

In the embodiment of FIGS. 1, 2, 4, 5 and 6, the slots 12 and 13 of the receptacle and one of the openings 15 of said receptacle are positioned in close, generally triangular proximity in said receptacle and will receive conventional 3 wire and 2 wire polarized plugs. The other of the openings 14 is positioned in spaced relation with the slots 12 and 13 and with the opening 15 in the receptacle. The opening 14 is adapted to accommmodate the prong 10 of the ground conductor 4.

In the embodiment of FIGS. 9, 10 and 11, the slots 12 and 13 and the openings 16 and 17 of the receptacle are positioned in close proximity in said receptacle on lines intersecting each other at right angles. The slots 12 and 13 and the opening 16 are positioned to receive conventional 3 prong plugs or 2 prong polarized plugs. The plug member 19 supports the prongs in close proximity with the flat prongs 7 and 8 spaced from each other in parallel relation on a first line and the U-shaped cross-section prongs 9 and 10 spaced from each other and opening away from each other on a second line intersecting the first line at right angles thereto. The flat prongs and U-shaped ground prongs are spaced for insertion into the receptacles 9, 10, 11.

in the plug member 19 the U-shaped cross-section prong 9 is positioned in closer proximity with the first line through the flat prongs 7 and 8 than the conventionally spaced U-shaped prong 10 to prevent reversal of the plug and polarity.

Thus, as described, the redundant grounding system of the invention comprises a two plug and receptacle system (FIGS. 1, 2, 3, 4, 5, 6) and a single plug and receptacle system (FIGS. 8. 9, 10, 11).

The two plug system converts any standard receptacle such as, for example, a Hubbell No. 5262, illustrated in FIG. 4, 11*a*, into a redundant grounding system with the installation of an adapter plate 11*b* (FIGS. 4, 5 and 6). FIG. 1 further illustrates the two plug redundant grounding system in a typical electrical installation. FIG. 2 illustrates a conventional receptacle with a built-in redundant grounding receptacle for use with the two plug system. FIG. 3 illustrates the parking facility provided for the redundant grounding plug 19.

FIG. 8 illustrates the single redundant grounding plug. When inserted into the receptacle of FIG. 9, both the conventional grounding and redundant grounding circuits are completed simultaneously. The connector body of FIG. 10 is utilized for the construction of extension cords with redundant grounding. FIG. 11 illustrates a converter for the use of appliances wired for redundant grounding on conventional receptacles. The connection of a green conductor to the receptacle plate screw will provide redundant grounding.

While the invention has been described by means of specific examples and in specific embodiments, I do not wish to be limited thereto, for obvious modifications will occur to those skilled in the art without departing from the spirit and scope of the invention.

I claim:

1. A redundant electrical grounding system, comprising electrically conductive means including two current conductors and two ground conductors each covered with electrical insulation and all housed in an overall sheath of electrical insulation;

a plurality of electrically conductive prongs including two prongs of substantially flat configuration each electrically connected to a corresponding one of the current conductors and two prongs of substantially U-shaped cross-section each electrically connected to a corresponding one of the ground conductors; and a receptacle haveing a pair of slots for accommodating the flat prongs of the current conductors and a pair of openings for accommodating the U-shaped cross-section prongs of the ground conductors and electrically conductive means extending to said slots and openings for making electrical contact with the prongs.

2. A redundant electrical grounding system as claimed in claim 1, further comprising a plug member affixed to the electrically conductive means and supporting the flat prongs and one of the U-shaped cross-section prongs, the prongs being electrically connected to the corresponding conductors in the plug member, one of the ground conductors extending out of the overall sheath at a distance from the plug member and having the other of the U-shaped cross-section prongs affixed thereto.

3. A redundant electrical grounding system as claimed in claim 1, further comprising a plug member affixed to the electrically conductive means and supporting the prongs, the prongs being electrically connected to the corresponding conductors in the plug member.

4. A redundant electrical grounding system as claimed in claim 2, wherein the slots and one of the openings are positioned in close generally triangular proximity in the receptacle and the other of the openings is positioned in spaced relation with the slots and the one of the openings in the receptacle, said other of said openings being adapted to accommodate the prong of the one of the ground conductors.

5. A redundant electrical grounding system as claimed in claim 3, wherein the slots and the openings are positioned in close proximity in the receptacle on lines intersecting each other at right angles.

6. A redundant electrical grounding system as claimed in claim 3, wherein the plug member supports the prongs in close proximity with the flat prongs spaced from each other in parallel relation on a first line and the U-shaped cross-section prongs spaced from each other and opening away from each other on a second line intersecting the first line at right angles thereto, and the slots and openings of the receptacle are positioned in the identical pattern.

7. A redundant electrical grounding system as claimed in claim 6, wherein one of the U-shaped cross-section prongs is supported in close proximity with the first line and the other of the U-shaped cross-section prongs is supported in spaced relation with said first line.

* * * * *